US007876187B2

(12) United States Patent
Gibson et al.

(10) Patent No.: US 7,876,187 B2
(45) Date of Patent: Jan. 25, 2011

(54) ACTUATOR

(75) Inventors: Sarah Gibson, Sheffield (GB); Geraint W Jewell, Sheffield (GB)

(73) Assignee: Rolls-Royce plc, London (GB)

( * ) Notice: Subject to any disclaimer, the term of this patent is extended or adjusted under 35 U.S.C. 154(b) by 145 days.

(21) Appl. No.: 11/705,125

(22) Filed: Feb. 12, 2007

(65) Prior Publication Data

US 2007/0194873 A1 Aug. 23, 2007

(30) Foreign Application Priority Data

Feb. 17, 2006 (GB) ..... 0603171.0

(51) Int. Cl.
*H01H 9/00* (2006.01)
*H01F 3/00* (2006.01)
*H01F 7/08* (2006.01)

(52) U.S. Cl. ..... 335/279; 335/203; 335/261; 335/262

(58) Field of Classification Search ..... 335/261, 335/279, 262, 203, 220; 251/129.01–129.22; 244/76 A See application file for complete search history.

(56) References Cited

U.S. PATENT DOCUMENTS

| | | | | | |
|---|---|---|---|---|---|
| 750,132 | A * | 1/1904 | Timmis et al. | 335/261 |
| 1,436,639 | A * | 11/1922 | Bindschedler | 335/262 |
| 2,076,858 | A * | 4/1937 | Morgenstern | 335/279 |
| 2,407,603 | A | 9/1946 | Derungs | |
| 2,407,963 | A * | 9/1946 | Persons | 335/261 |
| 2,869,048 | A * | 1/1959 | Reed | 335/272 |
| 2,892,134 | A * | 6/1959 | Kruithof et al. | 335/255 |
| 2,930,945 | A * | 3/1960 | Weathers et al. | 335/230 |
| 3,622,819 | A * | 11/1971 | Koehler | 310/25 |
| 3,805,204 | A * | 4/1974 | Petersen | 335/255 |
| 4,216,454 | A * | 8/1980 | Ohtani et al. | 335/262 |
| 4,569,504 | A * | 2/1986 | Doyle | 251/129.15 |
| 4,577,174 | A | 3/1986 | Lemmer | |
| 4,604,600 | A * | 8/1986 | Clark | 335/261 |
| 4,633,209 | A | 12/1986 | Belbel | |
| 5,565,832 | A * | 10/1996 | Haller et al. | 335/249 |
| 5,752,308 | A * | 5/1998 | Maley et al. | 29/602.1 |
| 5,781,090 | A * | 7/1998 | Goloff et al. | 335/276 |
| 6,308,667 | B1 * | 10/2001 | Tsai et al. | 123/90.11 |
| 6,737,946 | B2 * | 5/2004 | Seale et al. | 335/279 |

FOREIGN PATENT DOCUMENTS

| | | |
|---|---|---|
| EP | 0 204 293 A | 12/1986 |
| GB | 0 551 790 SP | 3/1943 |
| JP | 2003188014 AB | 7/2003 |

* cited by examiner

*Primary Examiner*—Elvin G Enad
*Assistant Examiner*—Alexander Talpalatskiy
(74) *Attorney, Agent, or Firm*—Jeffrey S. Melcher; Manelli Denison & Selter PLLC

(57) ABSTRACT

With variable airgap reluctance actuators problems arise due to the relationship between actuator mass and displacement range. By providing opposed surfaces in the actuator stator core and armature which have undulations typically in the form of grooves, slots and projections, a greater displacement range can be achieved whilst maintaining performance above a rated displacement force characteristic. In such circumstances by establishing a necessary rated displacement force characteristic, an actuator can be tailored and designed to meet that characteristic over a desired displacement range which has significantly less mass in comparison with a prior actuator arrangement having flat surfaces.

15 Claims, 5 Drawing Sheets

PRIOR ART

ACTUATOR

FIELD OF THE INVENTION

The present invention relates to actuators and more particularly to variable airgap reluctance actuators particularly when utilised with respect to aerospace and gas turbine engine applications.

BACKGROUND OF THE INVENTION

Cylindrical linear actuator devices are well known. FIG. 1 provides a schematic cross section of an example variable airgap reluctance actuator 1. The actuator 1, in which the airgap gradually closes up, has an armature 2 attracted to a stator core 3. Such linear actuators are particularly suited to applications which require relatively high levels of force and a robust construction. In such circumstances, these actuators can be utilised for linear actuation situations within relatively hostile gas turbine environments such as with respect to active control of blade tip clearance, vibration cancellation and other miscellaneous situations where a linear motion is required.

As can be seen in FIG. 1 an electrical coil or coils 4 are provided within the stator core 3. In such circumstances when the coil or coils 4 are energised, relative movement in the direction of arrowheads 5 is provided in an antagonistic relationship with magnetic attraction causing movement in one direction and typically gravity or a return bias spring or other mechanical device which produces a force that opposes the actuator. It will also be understood in certain circumstances the direction of electrical current flow in the coils 4 may be switched in order to cause the relative movements. Thus, by the effects of the coils 4 and a return bias/gravity respective movements in the direction of arrowheads 5 is provided as required.

Although actuators of the type shown in FIG. 1 are capable of producing large specific forces with a displacement in the direction of arrowhead 5, the general construction of the actuator 1 has a disadvantage in that the magnitude of the reluctance force at a given current varies approximately with the square of airgap width between opposed surfaces 6, 7 dependent upon such effects as saturation. In such circumstances, application of variable airgap reluctance actuators is currently limited to displacement strokes which are normally, but not exclusively, in a range below 1 mm.

Clearly, there is a significant requirement for medium displacement actuators which can cause displacement in the range of a few millimetres, but in view of the structure as described above, provision of variable airgap reluctance actuators for such longer range displacement applications is impeded by the size and mass related penalties with regard to the size of the armature and stator core as well as electrical coils. FIG. 2 provides a graphic illustration of predicted force to displacement characteristics for three optimised reluctance actuator designs which are capable of producing 1 kN displacement forces for 1, 2 and 3 mm armature displacement strokes. It will be noted in each case the armature and stator core are manufactured from a mild steel, while the electrical current densities in the coils are set at 5 amps per sqm due to thermal considerations with a copper packing factor of 65%. In such circumstances, as can be seen, for a 1 mm displacement stroke a 2.09 Kg actuator is required, whilst for a 2 mm displacement stroke a 3.8 Kg actuator is required and a 3 mm displacement stroke results in an actuator with a mass of 5.7 Kg. In such circumstances, it will be understood that there is a considerable increase in the actuator mass associated with extending a 1 kN force capability to longer displacement strokes. Such limitations severely limit the convenient use of airgap reluctance actuators in severe environments, such as those associated with aerospace applications.

SUMMARY OF THE INVENTION

In accordance with certain aspects of the present invention there is provided an actuator comprising an armature and a stator with electrical coils arranged when energised to cause relative displacement between the armature and the stator, the stator and the armature having opposed surfaces with an airgap between them, the opposed surfaces having undulations projecting towards each other.

Generally, the undulations are reciprocal in the respective opposed surfaces of the armature and the stator. Possibly, the undulations are provided by slots in the opposed surfaces. Possibly, the slots are rectangular or mortice or truncated tapered or point tapered, or a combination of such cross sections.

Possibly, the undulations vary in depth. Alternatively, the undulations have a consistent depth across the shared gap between the opposed surfaces.

Generally, the undulations in terms of distribution and/or depth are determined dependent upon a desired displacement range and an electrical coil capacity to cause relative displacement between the armature and the stator across the airgap.

Generally the actuator is cylindrical. Alternatively, the actuator is a generally polyhedral prism.

BRIEF DESCRIPTION OF THE DRAWINGS

Embodiments of certain aspects of the present invention will now be described by way of example only and with reference to the accompanying drawings in which:—

DETAILED DESCRIPTION OF THE INVENTION

As indicated above, enhancing the potential convenient displacement stroke range of variable airgap linear reluctance actuators to a wider number of industries has clear benefits. However, the inverse square relationship between force and displacement distance causes difficulties in achieving desired medium displacement stroke lengths for acceptable actuator weight and size. The present actuator is designed to adjust the previous flat opposed surface relationship between the armature and stator core by incorporating undulations in these opposed armature and stator pole surfaces. This arrangement will provide an additional component to the actuator force such that in association with phasing with regard to this actuator force it is possible to create greater displacement/lengths to axial force capability for wider airgaps.

Figure 3:
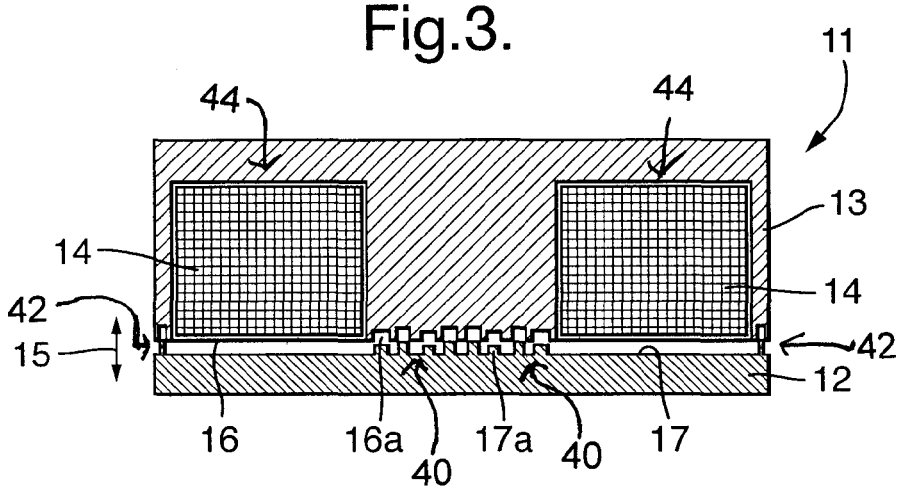
FIG. 3 is a schematic cross section of an actuator.

FIG. 3 provides a schematic cross section of one example of an undulation arrangement. Thus, the actuator 11 again comprises an armature 12 and stator core 13 with a coil or coils 14 located to cause displacement in the direction of arrowheads 15 across an airgap between opposed surfaces 16, 17 of the stator core 13 and armature 12. These opposed surfaces 16, 17 incorporate undulations 16*a*, 17*a* in appropriate configurations to provide the axial force component as described previously to adjust the force capability over a larger airgap between the surfaces 16, 17. The opposed surface 16 of the stator core 13 has inner poles 40 and outer poles 42 defining a slot 44 in which the coils 14 are mounted.

In a preferred embodiment the actuator is generally cylindrical about an axis perpendicular to the airgap between opposed surfaces. The advantage of this is that the coils are only open to the air at the airgap and, therefore, end effects caused by exposure of the windings to air are reduced or obviated. In alternative arrangements the actuator is a generally polyhedral prism, where the base polyhedron is a rectangle, pentagon, hexagon or other suitable shape. These arrangements all retain the essential advantage of the cylindrical arrangement, namely reducing or obviating end effects.

It will be understood that the specification of these undulations 16*a*, 17*a* can be chosen in terms of distribution, depth and shaping in order to control the phasing of the various force contributions on the reluctance created by energising the electrical coils 14. Typically, the design of the undulations 16, 17 will be as shown and so have a reciprocal relationship between the undulations in the opposed surface 16*a* with undulations in its opposed surface 17*a* and vice versa. The undulations 16*a*, 17*a* will generally have an equal depth to allow controlling of the phasing of the forces as described above, but this may be altered along with also changing the width, distribution and shape of the undulations 16*a*, 17*a*.

Typically, the undulations 16*a*, 17*a* will take the form of rectangular slots for ease of manufacture and predictability with regard to response but as will be described later with regard to FIG. 5, alternate slot configurations are possible.

Figure 7A:
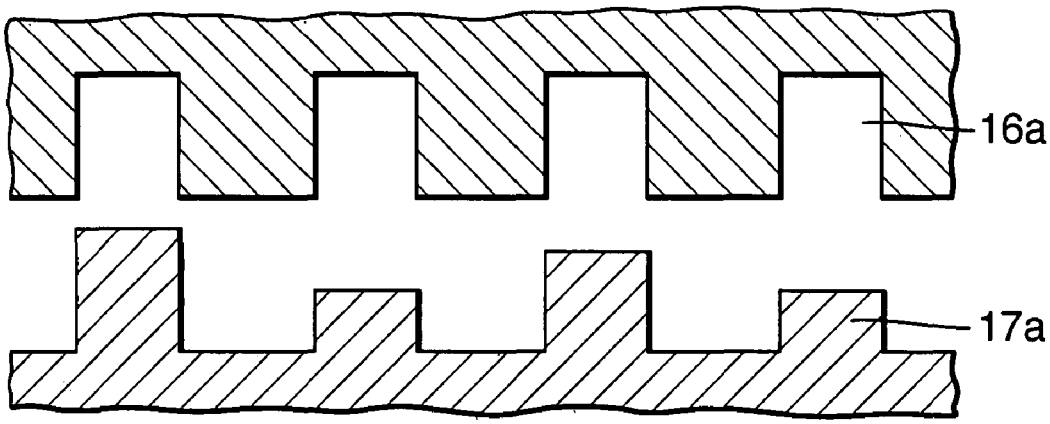
FIGS. 7*a* and 7*b* are schematic cross section enlargements of alternative undulation arrangements wherein the undulations are disengaged.
Figure 7B:
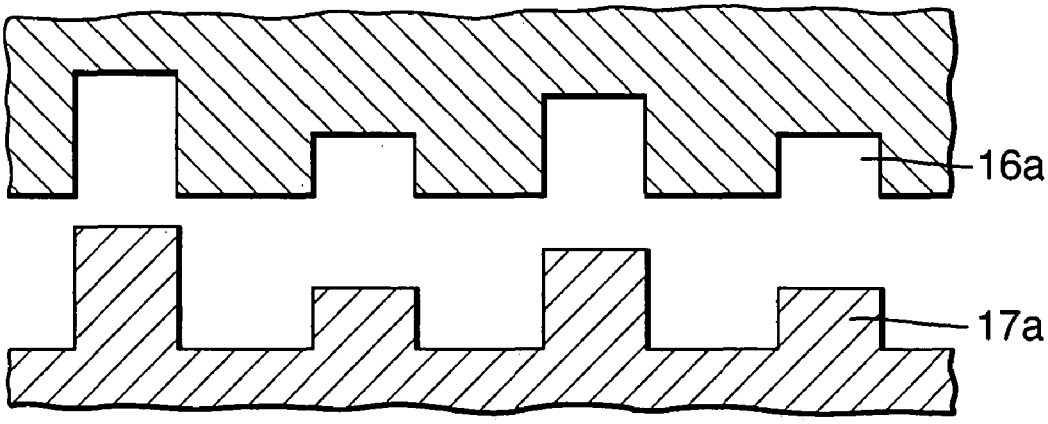

The undulations typically comprise projections 17*a* in one of the opposed surfaces 17 and recesses 16*a* in the other opposed surface 16. When the electrical coils 14 are energised in the undulations 16*a*, 17*a* move between a first, disengaged position in which the projections 17*a* are unenclosed by the recesses 16*a*, as shown in FIG. 7*a* or 7*b*, to a second, overlapped position in which the projections 17*a* are fully or partially within the recesses 16*a* as shown in FIG. 5. An intermediate position is shown in FIG. 7*c*.

The rate of change of stator flux linkage with armature displacement, which is proportional to force, tends to be a maximum at or near the onset of the overlap of the projections 17*a* and recesses 16*a*. Once there is significant overlap this rate of change of flux linkage with armature displacement tends to diminish, but there is some additional force produced. As a consequence there is a peak in the force produced by a given pair of projection and recess as they start to overlap. By providing a plurality of different recess depths and/or projection heights it is possible to arrange for different pairs of projections and recesses to start to overlap at different positions of the armature displacement. FIG. 7*c* shows some of the recess and projection pairs overlapped and other pairs disengaged.

Figure 7C:
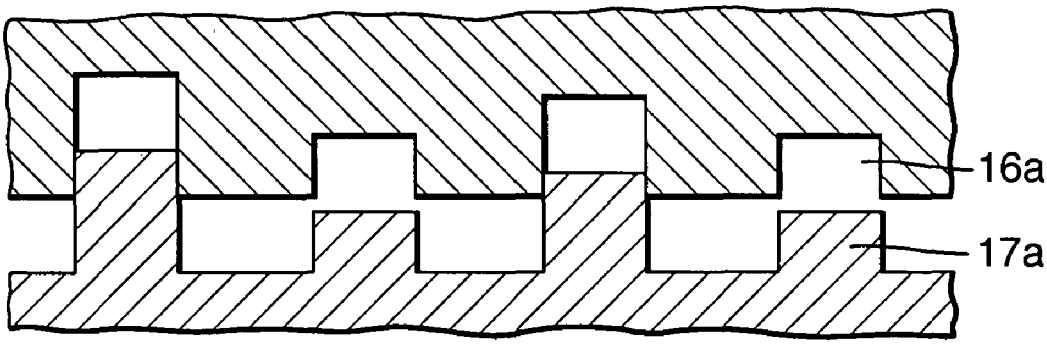
FIGS. 7*c* is a schematic cross section enlargement of the undulation arrangement of FIG. 7*b* wherein the undulations are partially overlapped.
Figure 8:
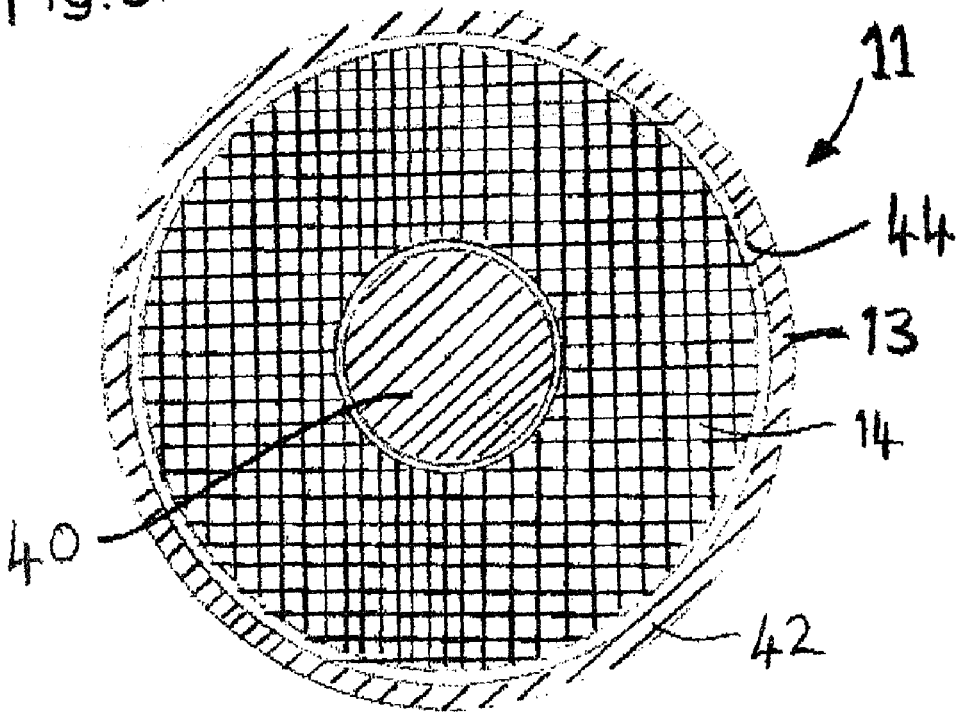
FIG. 8 illustrates a cross section through a cylindrical actuator.
Figure 9:
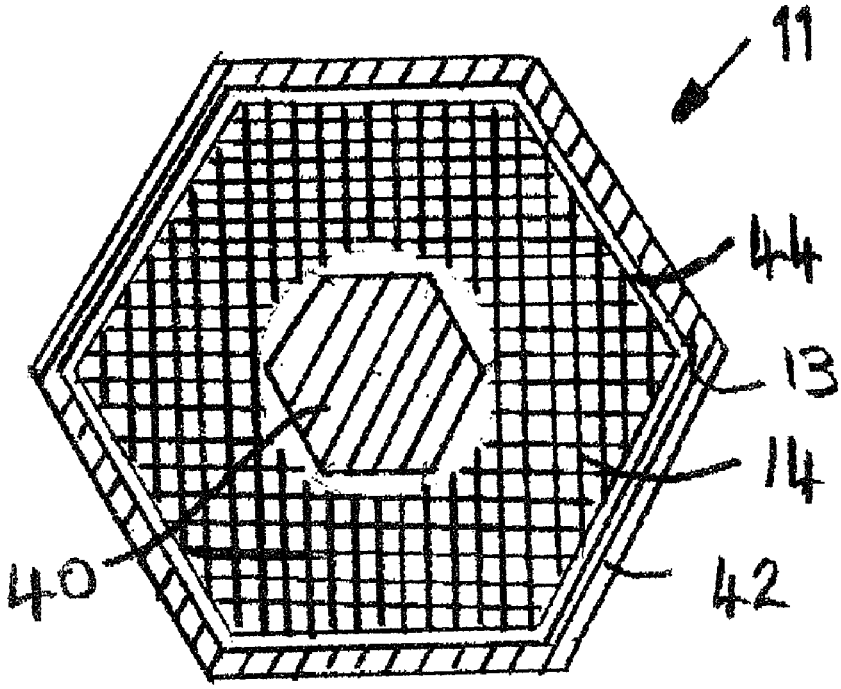
FIG. 9 illustrates a cross section through a polyhedral prism actuator.

One advantage of the arrangement of the present invention derives from the appropriate phasing of these force maxima by varying the recess depths and/or projection heights to produce a more constant force over a greater displacement stroke range, as shown in FIGS. 7*a*, 7*b* and 7*c*.

Figure 6:
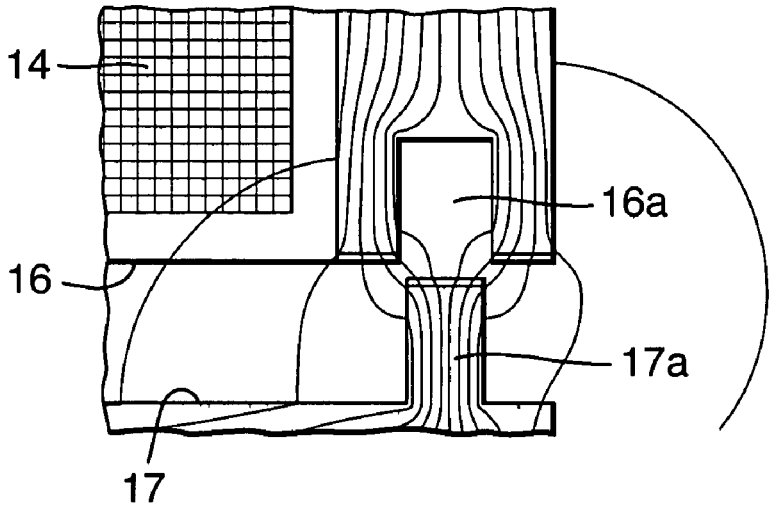
FIG. 6 is a schematic cross section enlargement of part of the actuator of FIG. 3.

A second advantage derives from the normal forces produced between opposed, preferably flat faces of adjacent projections 17*a* and recesses 16*a*. Flux passes between these faces when the projections 17*a* and recesses 16*a* are fully disengaged and produces a component of normal forces as shown in FIG. 6. This becomes negligible once the undulations 16*a*, 17*a* overlap.

Figure 1:
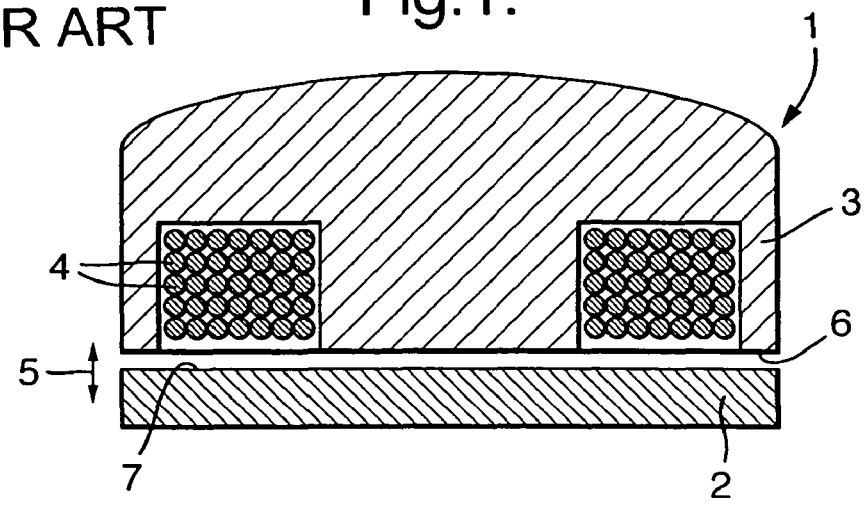
PRIOR ART Fig.1.
FIG. 1 is a schematic cross-section of a prior art variable airgap reluctance actuator.
Figure 2:
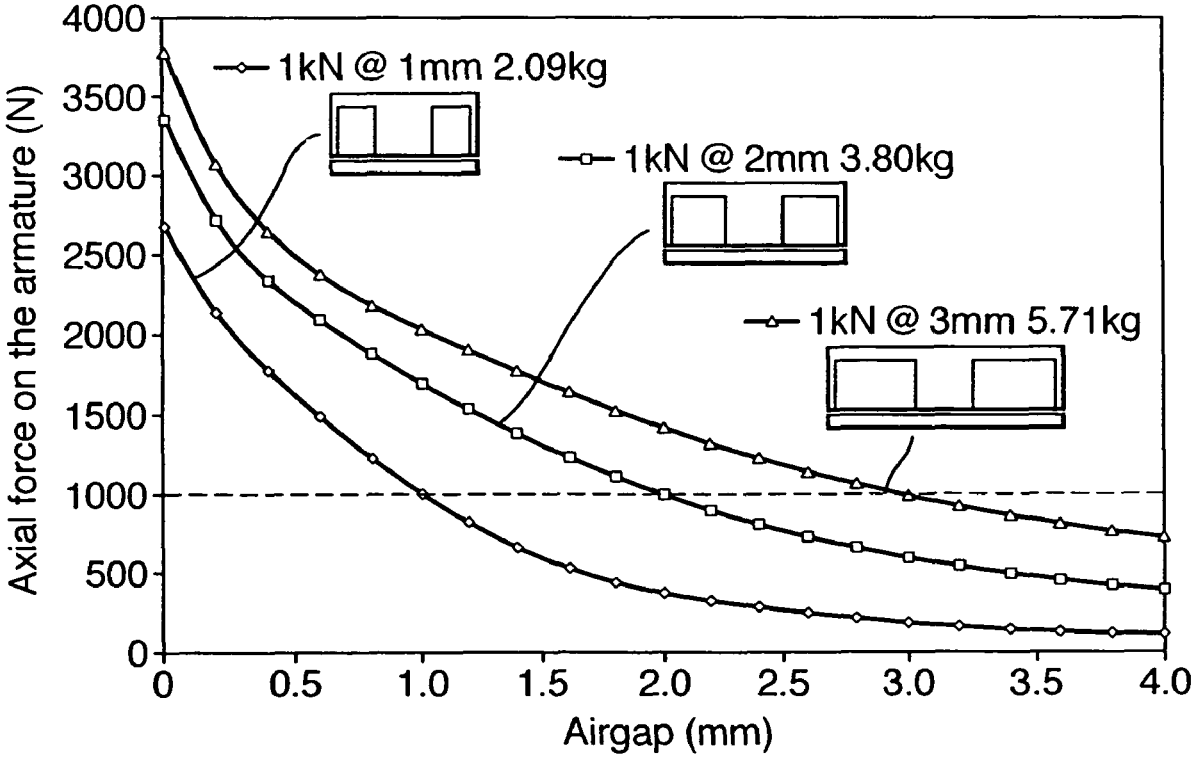
FIG. 2 is a graphic illustration of predictive axial force relative to airgap for a prior art actuator.

By the appropriate phasing of the displacement force as a result of variations in the undulations 16*a*, 17*a* as indicated above, the displacement stroke range over which a desired rated force of displacement can be produced is extended without increasing the mass of the actuator on a similar scale to that depicted in FIG. 2.

Figure 4:
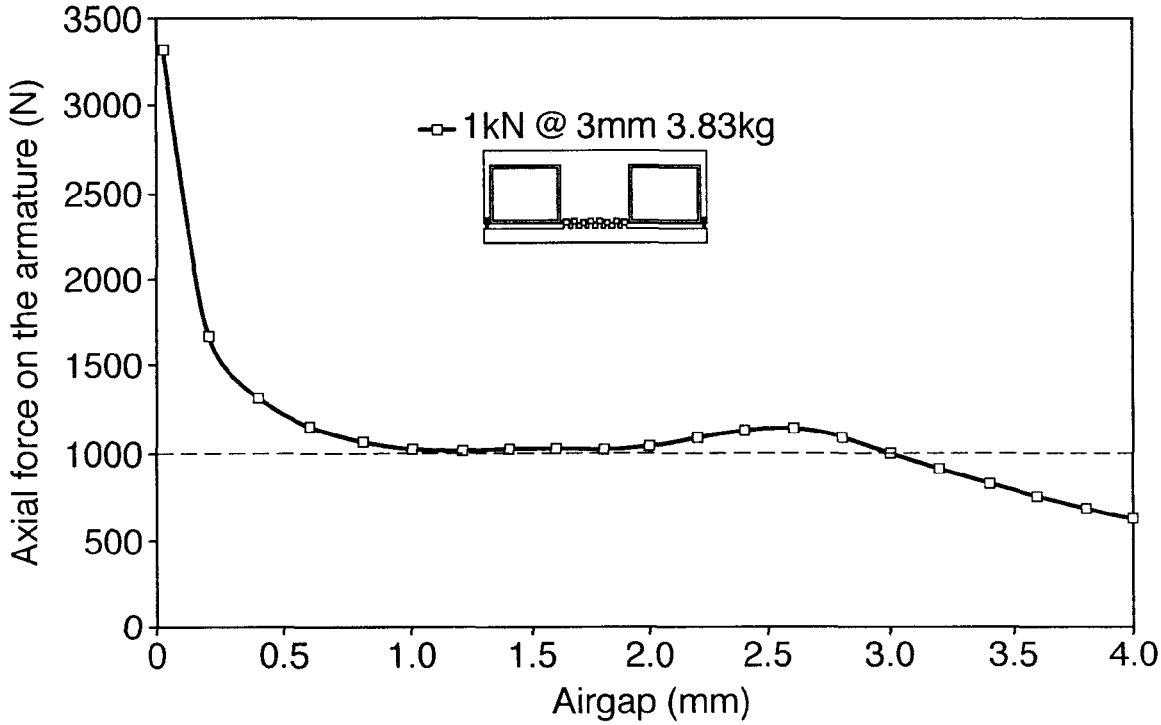
FIG. 4 is a graphic illustration of axial force relative to airgap for an actuator in accordance with aspects of the present invention.

FIG. 4 provides a graphic illustration of axial force against displacement length in terms of the airgap between the opposed surfaces for a typical actuator in accordance with aspects of the present invention. Thus, as can be seen in the optimised conditions of comparison in an actuator to produce a 1 kN displacement force at a 3 mm gap is substantially the same as the actuator mass depicted in FIG. 2 for a similar 1 kN displacement force at 2 mm, that is to say around 3.8 Kg. In such circumstances, on an optimised like for like basis the present undulating opposed surface actuator has a mass in the order of two thirds of that of a conventional airgap actuator which has the same displacement force and stroke length capability.

The above advantage is achieved through a compromise in terms of the displacement force for smaller airgaps. Thus, as can be seen there is a rapid reduction in the axial displacement force with an actuator in accordance with aspects of the present invention such that the actuator approaches the rated displacement force of 1000 N at approximately a 1 mm gap but through appropriate design of the undulations a rated axial force is maintained until there is a 3 mm airgap whilst with the comparative actuator depicted in FIG. 2 it will be noted that there is a more gradual reduction in the displacement force such that there is not an effective plateau in the axial displacement force and therefore generally a greater axial displacement force at narrower airgaps. Again referring to the illustrations, it will be noted that with an air gap of 0.5 mm a conventional flat opposed surface actuator in the order of 3.8 Kg will produce an axial displacement force of 2000 Newtons, whilst with the present undulating opposed surface actuator the axial displacement force is only in the order of 1200 N. Nevertheless, it will be appreciated that consistency and achieving the rated axial displacement force criteria predictability with a lower actuator mass allows a reliability which can be used to ensure a good match between actuator characteristics and application requirements. In short, the excess actuator displacement force provided above the rated necessary actuator displacement force is a luxury which can be dispensed with for the greater advantage of a lower actuator mass for the same rated axial displacement force over a comparatively longer displacement stroke length.

As indicated above the present actuator can be utilised in a wide range of applications, but there are particular advantages in weight conscious applications in the aerospace technologies. It will be understood that the actuator allows a shift in the actuator force response to increase the displacement length over which a rated force response can be achieved in comparison with previous actuators with flat opposed surfaces. In such circumstances, by determining the necessary rated axial displacement force response required an actuator configuration in accordance with aspects of the present invention can be determined through appropriate undulations in the opposed surfaces of the armature and stator core. This configuration will have a like for like lower mass, but will still achieve the rated desired axial displacement force over the specified displacement stroke range required. It will be appreciated in the practical embodiment generally a 10% over rating in comparison with necessary axial displacement force and displacement range may be provided, but even with such over rating a reduction in mass may be achieved.

As indicated above, undulations in accordance with aspects of the present invention can take a number of forms. Generally there will be a matched reciprocal relationship between undulations in the respective opposed surfaces of the armature and stator core. FIG. 5 illustrates for example, undulation configurations in the opposed surfaces possible with an actuator in accordance with aspects of the present invention.

Figure 5A:
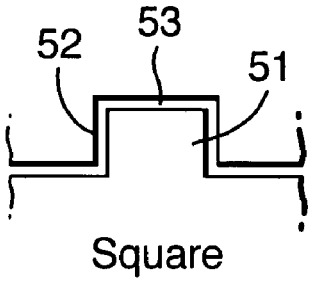
FIG. 5 provides schematic illustrations of alternate undulations in opposed surfaces in accordance with aspects of the present invention.

In FIG. 5*a* a rectangular or square cross section undulation is illustrated such that an actuator has a turret like square element 51 which extends into a slot 52 formed in a stator core with an airgap 53 between them. Thus, as described above, the turret 51 will enter the slot 52 in order to create the airgap 53 which, through appropriate reluctance and magnetic forces, will cause displacement in that gap 53 and therefore the actuator in use.

Generally, it will be easier to form a rectangular or square slot or trench in the stator core or armature. In such circumstances, one side of the opposed surface in the actuator as illustrated with regard to FIGS. 5*b*, 5*c* and 5*d* may be a rectangular slot whilst an opposed part has a different cross section to achieve a different response in an actuator in accordance with certain aspects of the present invention to allow adjustment of that response to achieve the desired rated displacement force over the desired displacement stroke range.

Figure 5B:
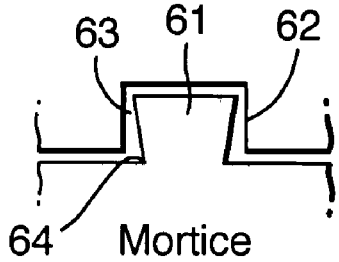

In FIG. 5*b* it will be noted that again a stator core has a slot 62 which is generally rectangular whilst an entrant element 61 of the armature takes the form of a mortice cross section with chamfering to a narrower waist 64 at its base. In such circumstances an airgap 63 between the slot 62 and the element 61 is variable. This variation in the course of displacement will also vary within the inter engagement between the opposed surfaces.

Figure 5C:
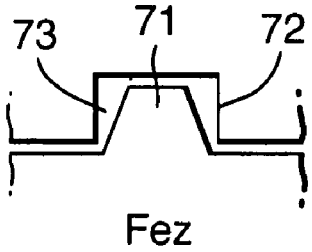

FIG. 5*c* again illustrates a slot 72 in a stator core which is substantially rectangular whilst an entrant element 71 of an armature has a tapering cross section to a flat truncation such that again there is a variation in airgap 73 between the opposed surfaces of the element 71 and the slot 72. This variation in the airgap 73 will alter with axial displacement between the slot 72 and the element 71 and again allow adjustment of the response force.

Figure 5D:
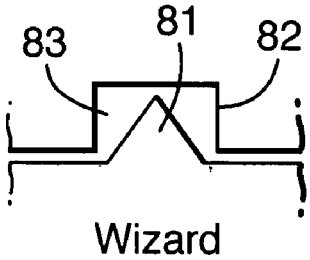

FIG. 5*d* illustrates a further configuration for an actuator in terms of its opposed surfaces in its armature and stator core. Thus, a rectangular slot 82 is provided in a stator core with an element 81 formed in an armature. This element 81 enters the slot 82 and has a cross section which tapers to a point in a triangular fashion. In such circumstances an airgap 83 between the element 81 and the slot 82 varies with relative displacement between the element 81 and 82 in actuator operation. This variation will adjust the displacement force response and will again therefore through design provide an alternative configuration for achieving desired rated displacement force response for the desired displacement stroke range.

It will be understood that the slots may be in the armature and the shaped undulations in the core or vice versa dependent upon requirements and ease of manufacture.

The undulations, as indicated above, generally take the form of slots or grooves in the stator core in order to create, as indicated, tailoring of the force characteristics generated. This tailoring introduces additional tangential components to the force between the stator and the armature. The tangential components of the force contribution are produced in each matching groove and projection in terms of undulations in the opposed surfaces can be individually phased with respect to the armature displacement by selecting different recessed depths and projection heights for the undulations as discussed above. Such an approach provides significant flexibility in terms of the control which can be exercised at a design stage over the force displacement characteristics. However, incorporating these features as indicated, will eventually incur a penalty in terms of reduced forces at smaller airgaps since the effective pole surface areas which inter-engage to initiate contact are reduced. By creating undulations there can be many degrees of design freedom in terms of the number, distribution and dispersion of the undulations in the form of grooves and projections. The extent to which this design freedom can be exploited is inevitably constrained by practical considerations. This is particularly the case for grooves located at the outer edge of the actuator, since in order to maintain an equal cross sectional area with the inner pole face, its radial thickness is considerably smaller.

Although in principle there is no requirement for every stator recess and its associated projection as undulations in the respect of opposed surfaces in the armature and stator to come into contact when the armature is in its closed, overlapped position this is likely to be desirable in most applications in order to enhance the holding force capability. However, it should be recognised that manufacturing such a complex structure will inevitably dictate that intimate contact will only occur over a portion of these areas. Indeed, this type of device is not well suited to applications where the holding force is particularly reliant on achieving a near ideal contact in the closed position as might be achieved with two flat opposed surfaces.

In a typical design four undulations will be provided on the inner poles 40, with a single recess on the outer poles 42. In each recess undulation and its corresponding projection, the undulations in the form of recesses and projections may have the same depth, that is to say nominally no residual airgaps in the fully closed, overlapped position.

By analysis the maximum contribution from the tangential component of force contribution is likely to occur around the onset of overlap between undulations in the opposed surfaces.

In terms of obtaining the best performance, the dimensions of the undulations are typically optimised in terms of balance between the magnetic flux carrying capability of the core and the coil cross section. However, since the net flux in the magnetic circuit is modified by the inclusion of the undulations in the form of grooves in the stator pole face, the relative proportions of stator assigned to the coil and core may no longer be most appropriate. Further analysis can predict that the magnetic field distribution, at least towards the end of the displacement range, demonstrates a considerable concentration of magnetic flux at the corners of the armature undulations with a magnetic flux density in the order of 2 T at the rated stator mmf. Such results suggest that employing Cobalt-Iron which has a saturation flux density which is some 15% greater than mild steel yields some benefits in terms of enhancing the tangential force distribution at the onset of overlap between the undulations in the opposed surfaces of the armature and the stator core. A large portion of this radially oriented field contributes little in the way of additional force, as this is predominantly generated near the corners, but does increase the overall flux levels in the stator core and armature and hence promotes magnetic saturation. This factor when combined with reduced pole face surface areas over which a normal component force is generated leads to the significant reduction in force. In such circumstances when designing the undulations in the opposing surfaces care must be taken when considering the influence of additional features in the entire magnetic surface rather than simple addition to an existing design.

In terms of achieving a practical design, it will be appreciated that an actuator stator and armature may be taken such that a stator core is wound with 230 series turns which comprises two parallel strands of 1.32 mm diameter wire giving rise to a net copper packing factor within the coil itself in the order of 0.61. However, when due account is taken of the coil bobbin, which has a wall thickness of 1 mm, the net copper area as a portion of the overall slot cross section is 0.54. In a reference design an electrical current density of 5 amps per sqm may be utilised which assumes a 0.65 packing factor will therefore achieve an axial current density in the order of 6 amps per sqm which corresponds to an input electrical current of 13.66 amps. By such an arrangement utilising appropriate undulations in the opposing surfaces, it is possible to design an actuator which meets a rated displacement force over a desired displacement range. As indicated above, the actual design of the undulations in terms of grooves, slots and projections will be dependent upon appropriate initial theoretical analysis and then prototype testing until the desired performance is achieved.

It will be understood by careful optimisation of the number and dimensions of the undulations in the stator and corresponding armature opposing surfaces, considerable control can be exercised with regard to the force versus displacement characteristic. It is understood that practical considerations limit the minimum projection widths in terms of manufacturing capabilities which can be reliably produced. Hence, in actuators with diameters in the order of 100 mm, the number of projections is likely to be relatively low typically with a limit of 5. However, in larger actuators with diameters of several hundreds of millimetres there is considerably greater flexibility for fine tuning the force versus displacement characteristics since a large number of recesses can be incorporated.

Modifications and alterations to the present invention will be understood by those skilled in the art in particular, as indicated above, the particular design of the undulations in the form of projections, slots and grooves in the opposing surfaces can be adjusted to achieve desired performance. Furthermore, the materials from which the stator core and armature are formed will significantly affect the magnetic flux generated and therefore the performance with regard to displacement force relative to displacement range. It will be understood that the undulations in the stator comprises a plurality of projections extending from the surface of the stator towards the armature and the armature comprises a plurality of projections extending from the opposing surface of the armature towards the stator and projections on the stator are arranged to align/coincide with slots formed between the projections on the armature and projections on the armature are arranged to align/coincide with slots formed between the projections on the stator.

We claim:

1. An actuator comprising:

an armature;

a stator; and electrical coils, the electrical coils being arranged, when energised, to cause relative displacement between the armature and the stator, the stator and the armature having opposed surfaces with an airgap between them, the opposed surfaces having undulations, the undulations comprising a plurality of projections from one opposed surface towards the other opposed surface, each projection having a maximum height and the maximum heights vary, and a plurality of recesses in the other opposed surface whereby in use the projections and recesses are movable between a first position in which the projections are unenclosed by the recesses and a second position where the projections are within the recesses.

2. An actuator as claimed in claim 1 wherein the undulations are reciprocal in the respective opposed surfaces of the armature and the stator.

3. An actuator as claimed in claim 1 wherein the undulations are provided by slots in the opposed surfaces.

4. An actuator as claimed in claim 1 wherein the cross-sectional shape of the projections is at least one of the group comprising rectangular, mortice, truncated tapered and point tapered.

5. An actuator as claimed in claim 1 wherein the undulations have a consistent depth across the gap between the opposed surfaces.

6. An actuator as claimed in claim 1 wherein the actuator is generally cylindrical.

7. An actuator as claimed in claim 1 wherein the actuator is a generally polyhedral prism.

8. A gas turbine engine incorporating an actuator as claimed in claim 1.

9. An actuator comprising:

an armature;

a stator; and electrical coils, the stator and the armature having opposed surfaces with an air gap between them, the opposed surface of the stator comprising an inner pole and an outer pole that defines a slot therebetween, the electrical coils being mounted in the slot, and the electrical coils being arranged, when energised, to cause relative displacement between the armature and the stator, the opposed surfaces having undulations comprising projections from one opposed surface towards the other opposed surface and recesses in the other opposed surface, each projection having a maximum height and the maximum heights vary, whereby in use the projections and recesses are moveable between a first position in which the projections are unenclosed by the recesses and a second position where the projections are within the recesses, and wherein a portion of the projections or recesses being disposed on the inner pole and a portion of the projections or recesses being disposed on the outer pole.

10. An actuator as claimed in claim 9 wherein the projections have heights and there are a plurality of different projection heights.

11. An actuator as claimed in claim 10 wherein the recesses have depths and there is a plurality of different recess depths.

12. An actuator as claimed in claim 11 wherein the depth of each recess is the same as the height of the corresponding projection.

13. An actuator as claimed in claim 10 wherein the recesses have depths and all the recesses have the same depth.

14. A gas turbine engine as claimed in claim 8 wherein the actuator provides active control of blade tip clearance.

15. An actuator comprising:

an armature;

a stator; and electrical coils, the electrical coils being arranged, when energized, to cause relative displacement between the armature and the stator, the stator and the armature having opposed surfaces with an airgap between them, the opposed surfaces having undulations, the undulations comprising a plurality of projections from one opposed surface towards the other opposed surface and a plurality of recesses in the other opposed surface, each projection having a maximum height and the maximum heights varying, whereby in use the projections and recesses are movable between a first position in which the projections are unenclosed by the recesses and a second position where the projections are within the recesses, wherein corresponding pairs of projections and recesses start to overlap at different positions of armature displacement from the stator to provide a more constant force over a greater displacement stroke range.

* * * * *